United States Patent [19]

Aoki

[11] Patent Number: 4,941,235

[45] Date of Patent: Jul. 17, 1990

[54] MAGNETIC LOCK CLOSURE DEVICE

[75] Inventor: Yoshihiro Aoki, Tokyo, Japan

[73] Assignee: Application Art Laboratories Co., Ltd., Tokyo, Japan

[21] Appl. No.: 346,158

[22] Filed: May 2, 1989

[30] Foreign Application Priority Data

Oct. 14, 1988 [JP] Japan ..... 63-258913

[51] Int. Cl.[5] ..... E05C 17/56

[52] U.S. Cl. ..... 24/303; 292/251.5

[58] Field of Search ..... 24/303, 688, 94, 113 MP; 292/251.5

[56] References Cited

U.S. PATENT DOCUMENTS

| | | |
|---|---|---|
| 1,193,227 | 9/1916 | Hinchey . |
| 1,198,227 | 9/1916 | Hinchey . |
| 2,223,898 | 12/1965 | Bey . |
| 2,340,781 | 2/1944 | Wagner . |
| 2,397,931 | 4/1946 | Ellis . |
| 2,453,021 | 11/1948 | Konelsky . |
| 2,475,226 | 7/1949 | Ellis . |
| 2,521,885 | 9/1950 | Vasquez . |
| 2,585,714 | 2/1952 | Wrobel et al. . |
| 2,615,227 | 10/1952 | Hornik . |
| 2,623,256 | 12/1952 | Feibelman . |
| 2,627,423 | 2/1953 | Copeman . |
| 2,637,887 | 5/1953 | Goodman . |
| 2,654,929 | 10/1953 | Feibelman . |
| 2,693,654 | 11/1954 | Clark . |
| 2,698,917 | 1/1955 | Van Urk et al. . |
| 2,784,757 | 3/1957 | Bosca et al. . |
| 2,812,203 | 11/1957 | Scholten . |

(List continued on next page.)

FOREIGN PATENT DOCUMENTS

| | | |
|---|---|---|
| 1711236 | 11/1955 | Fed. Rep. of Germany . |
| 1068149 | 10/1959 | Fed. Rep. of Germany . |
| A 27396 | 4/1962 | Fed. Rep. of Germany . |
| 2419407 | 4/1974 | Fed. Rep. of Germany . |
| 1586926 | 3/1970 | France . |
| 44-27953 | 11/1969 | Japan . |
| 47-16812 | 10/1972 | Japan . |
| 155313 | 7/1956 | Sweden . |
| 374845 | 11/1959 | Switzerland . |
| 914208 | 12/1962 | United Kingdom . |
| 1009996 | 11/1965 | United Kingdom . |
| 2192930 | 1/1988 | United Kingdom ..... 24/303 |

*Primary Examiner*—Victor N. Sakran

*Attorney, Agent, or Firm*—Wenderoth, Lind & Ponack

[57] ABSTRACT

A magnetic lock closure device has a first part or magnetically attracting part and a second part or magnetically attracted part, the first part including an annular permanent magnet having a center bore, a first ferromagnetic member formed like a disk plate and attached to one polarity side of the permanent magnet and a nonmagnetic outer cover having a center bore and enclosing the permanent magnet and first ferromagnetic member, and the second part including a second ferromagnetic member formed like a disk plate and adapted to be removably attached to the other polarity side of the permanent magnet. The first and second ferromagnetic members have respective ferromagnetic rods at the center extending therefrom and adapted to meet each other through the center bore when the first and second parts are coupled together. The closure device further has a shape of the permanent magnet and outer cover for accepting the ferromagnetic rod on the second ferromagnetic member and guiding the same into the center bore, and wherein the shape includes a funnel-shaped portion having an outwardly expanded opening extending from the center bore, and a peripheral flat portion extending radially outwardly from said outwardly expanded opening. The second ferromagnetic member may be shaped like a dish having a center bore and adapted to match the shape of the funnel-shaped portion and wherein it has a ferromagnetic rod extending through the center bore of the second ferromagnetic member and secured thereto.

1 Claim, 3 Drawing Sheets

U.S. PATENT DOCUMENTS 2,818,655 1/1958 De Gaston .
2,826,328 3/1958 Moen et al. .
2,884,698 5/1959 Würsch .
2,901,278 8/1959 Robinson .
2,915,681 12/1959 Troy .
2,954,253 9/1960 Teetor .
2,954,874 10/1960 Rouse .
2,970,857 2/1961 Squire .
2,975,497 3/1961 Budreck .
3,009,225 11/1961 Budreck .
3,038,232 6/1962 Wean .
3,041,697 7/1962 Budreck .
3,086,268 4/1963 Chaffin .
3,111,736 11/1963 Budreck .
3,111,737 11/1963 Heil .
3,141,214 7/1964 Bey ..... 24/303
3,141,216 7/1964 Brett .
3,171,176 3/1965 Shirley .
3,264,970 8/1966 Hersh et al. .
3,269,608 8/1966 Weber III .
3,277,681 10/1966 Bey .
3,324,521 6/1967 Humiston .
3,372,443 3/1968 Daddona .
3,502,318 3/1970 Merz .
3,509,734 6/1967 Lederer .
3,618,174 11/1971 Schainholz et al. .
3,722,360 3/1973 Blakey et al. .
3,781,047 12/1973 Surko, Jr. ..... 292/251.5
3,895,330 7/1975 Yost .
3,919,743 11/1975 Cutler .
4,021,891 5/1977 Morita .
B1 4,021,891 8/1986 Morita .
B2 4,021,891 9/1987 Morita .
4,453,294 6/1984 Morita .
4,458,395 7/1984 Aoki ..... 24/303
4,458,396 7/1984 Aoki ..... 24/303
4,505,007 3/1985 Aoki ..... 24/303

MAGNETIC LOCK CLOSURE DEVICE

BACKGROUND OF THE INVENTION

1Field of the Invention

The present invention relates to a magnetic lock closure device making use of the attractive action provided by a permanent magnet.

2. Description of the Prior Art

Conventionally, there is known a magnetic lock closure device that can be used on bags such as women's handbags, baggage, and the like as a locking device, or on clothing accessories such as waist belts. In either case, the magnetic lock closure device comprises a first part including an annular permanent magnet and a first ferromagnetic plate attached to one side of the permanent magnet that provides one polarity, and a second part including a second ferromagnetic plate which may be removably attached to the other side of the permanent magnet that provides the opposite polarity. The first part is completely enclosed by a nonmagnetic cover, and the first ferromagnetic plate may or may not have a rod at the center extending therefrom, which is also ferromagnetic. On the second part, the second ferromagnetic plate has a rod at the center extending therefrom, which is also ferromagnetic. When those two parts are to be coupled together, the second ferromagnetic plate can be engaged with the first part by engaging the rod on the second part with the rod on the first part or directly with the first ferromagnetic plate which in this case has no such rod, through the bore of the permanent magnet and cover. The two parts can be decoupled by pulling the second part away from the first part.

When the conventional magnetic lock closure device is employed for a handbag, for example, the first part which contains the permanent magnet is mounted on the body side of the handbag, and the second part is mounted on the flap side of the handbag. When the first and second parts are to coupled together under the attacting force of the first part, the second ferromagnetic plate is placed on the first part so that the rod on the second ferromagnetic plate can first engage the portion of the cover that is located between the outer marginal periphery of the annular permanent magnet and the periphral marginal edge of the bore through the magnet. This is because that portion of the outer cover or permanent magnet provides the highest magnetic flux density which tends to attract the rod on the second ferromagnetic plate more coercively than the other areas when the second part is placed on the first part. Then, an attempt is made to locate the bore through the outer cover and permanent magnet and force the rod on the second ferromagnetic plate into the bore by the most coercive attracting action of that portion. As the rod on the second ferromagnetic plate is magnetically attracted by that portion, it can only be moved away from that highest density area toward the bore in a zigzag fashion rather than directly, before it can successfully engage the bore. This may disadvantagously cause damage such as scratches on the outer cover.

Usually and in practice, prospective customers check to see if the devices on handbags or other articles will work well by trying to couple or decouple the two parts before they have decided upon one of their choice. In particular, the coupling action which involves the sliding motion may cause damage as described above that may degrade the commercial value of the articles. One practically proposed method whereby such damage can be prevented is to provide an additional protective sealing over the outer cover, or to provide a mesh pattern on the outer cover that hides any possible damages.

Another suggested method is to minimize the sliding motion of the rod on the second ferromagnetic plate onto the outer cover. This method may consist of providing a concavely-formed surface on the side of the permanent magnet that meets with the second ferromagnetic plate. The outer cover also has the corresponding surface on that side. This particular form may serve to guide the rod on the second ferromagnetic plate toward the center bore with minimum effort and therefore with minimum sliding motion. This particular form may be obtained by grinding or polishing an annular permanent magnet to conform to such form, but the grinding or polishing process is not adequate for the permanent magnet in particular, since the high dimensional or precision requirements that the permanent magnet must meet cannot be provided by the grinding or polishing process. This will disadvantageously affect the assembly process of the device that contains the thus formed permanent magnet as well as the other subassembly parts. Thus, the device that incorporates such a formed permanent magnet may not provide an attracting action that is strong enough to couple its two parts together magnetically. It is therefore to be noted that the products which have been manufactured in that manner may include many defective ones, which means a lower productivity or yield.

As an alternative solution to the above disadvantage, it has been suggested that an annular permanent magnet be provided with an additional part that may be formed from a ferromagnetic material as a yoke having a concavely formed surface on its one side. This yoke may eliminate the need of forming the permanent magnet itself, but will also increase the number of the component parts to be assembled. As the number of the component parts is increased, the accummulated dimensional errors for each individual part will become greater. Thus, the precision problem that will occur during the assembly process remains unsolved.

SUMMARY OF THE INVENTION

It is therefore a principal object of the present invention to provide a magnetic lock closure device that includes an annular permanent magnet having a center bore with its peripheral margin formed like a funnel specifically designed to guide the rod on the second ferromagnetic plate toward and into the center bore through the permanent magnet. All individual permanent magnets can advantageously be formed in this manner to meet the dimensional precision requirements.

In its specific form, the device may comprise a magnetically-attracting part or first part including an annular permanent magnet and a first ferromagnetic plate rigidly secured to one polarity side of the permanent magnet, these forming an integral unit enclosed by a nonmagnetic cover, and a magnetically-attracted part or second part including a second ferromagnetic plate which can removably be coupled with the first ferromagnetic plate on the first part. The nonmagnetic cover also has a center bore having its peripheral margin formed like a funnel, and is mounted to enclose the permanent magnet and second ferromagnetic plate. When the first and second parts are to be coupled together, the second part is placed on the other side of the permanent magnet having the opposite polarity so that the rod on the second ferromagnetic plate can be guided along the funnel toward the center bore through the cover and permanent magnet. It should be noted that, as one feature of the present invention, the funnel shape for each of the permanent magnet and cover has an expanded opening extending outwardly from the center bore and a peripheral margin extending radially outwardly from the expanded opening and having a flat surface. Thus, the second ferromagnetic plate can closely meet with the cover or permanent magnet.

The second ferromagnetic plate may have the flat form on the side meeting with the cover or permanent magnet, and preferrably it may be formed like a dish that conforms to the shape of the expanded opening in the funnel for the permanent magnet or cover. Preferrably, the second ferromagnetic plate may have a ferromagnetic rod extending therefrom which can engage the rod on the first ferromagnetic plate inside the center bore through the cover and permanent magnet. It should be noted that the outwardly expanded opening may be either flat or curved.

The functional features of the magnetic lock closure device according to the present invention may readily be appreciated by understanding how the device is operated. When the two parts of the device are to be coupled together, the second part is first placed upon the first part to allow the second ferromagnetic plate on the second part magnetically to be attracted by the permanent magnet on the first part. This action then causes the rod on the second ferromagnetic plate to be placed at any point on the outer cover that is located between the peripheral marginal edge of the permanent magnet and the marginal edge of the center bore through the magnet. Then, the second rod is magnetically attracted, and it may be guided into the center bore simply by sliding it along the funnel-shaped opening wall toward the center bore. As the path followed by the second rod from the point of its contact to the center bore is direct and shortest, any possible damage or scratches formed on the outer cover can advantageously be reduced to the minimum.

Another advantageous feature of the device according to the present invention is the mechanical design that can meet the high dimensional precision requirements, which may be achieved by providing a funnel shape having an expanded opening extending outwardly from the center bore and a peripheral marginal flat portion extending outwardly radially from the funnel shape. This ensures that the high dimensional precision can be provided by machining a particular permanent magnet in the direction of its depth or thickness by means such as grinding or polishing. The high dimensional precision that can be obtained in this way allows all the component subassembly parts or elements to be fabricated with the corresponding precision requirements.

BRIEF DESCRIPTION OF DRAWINGS

Those and other objects, features, and advantages of the present invention may be more clearly appreciated by reading the remainder of the specification in which some preferred embodiments will be described in further detail by referring to the accompanying drawings, in which.

DESCRIPTION OF THE PREFERRED EMBODIMENTS

Figure 1:
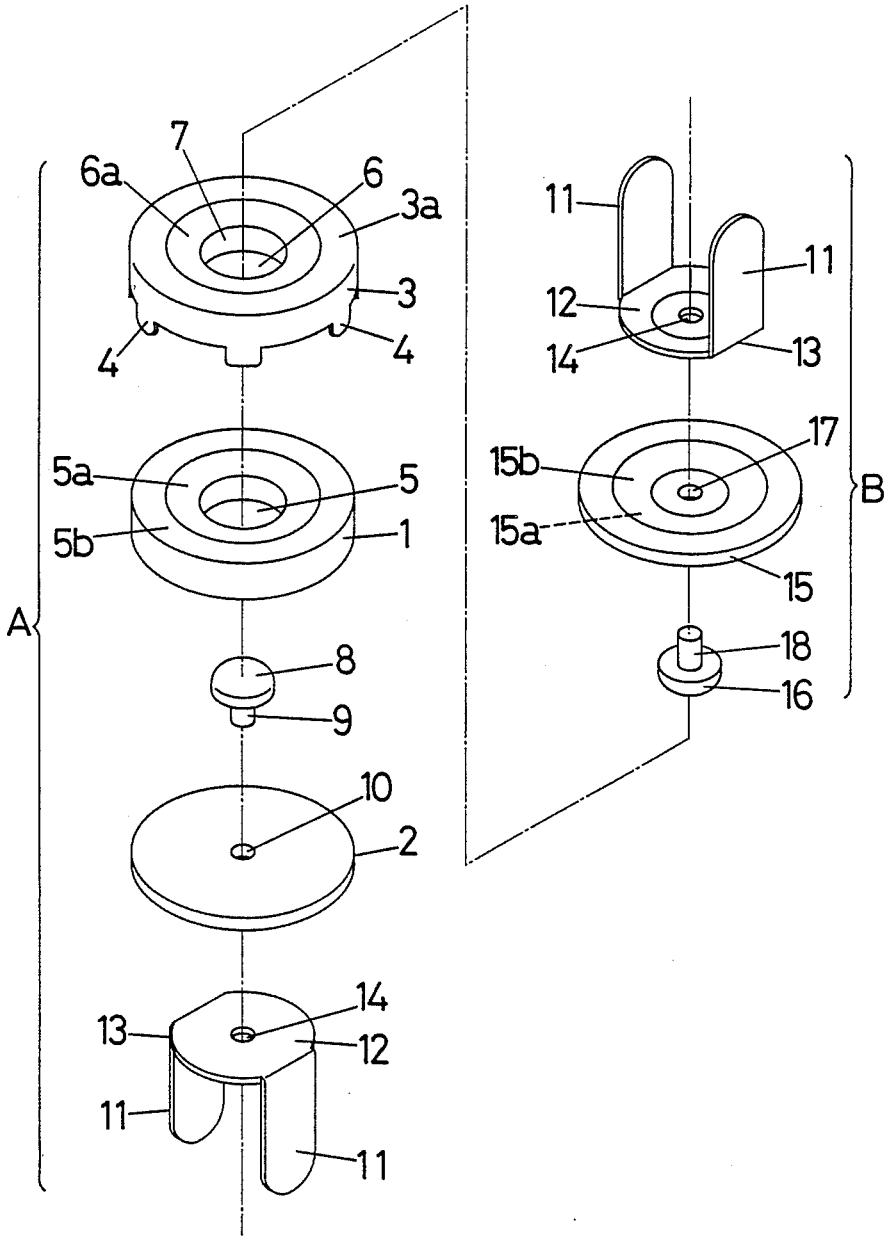
FIG. 1 is an exploded perspective view illustrating the component subassembly parts or elements which make up a magnetic lock closure device in one preferred embodiment of the present invention.

Several preferred embodiments of the present invention will now be described by referring to the drawings.

Figure 2:
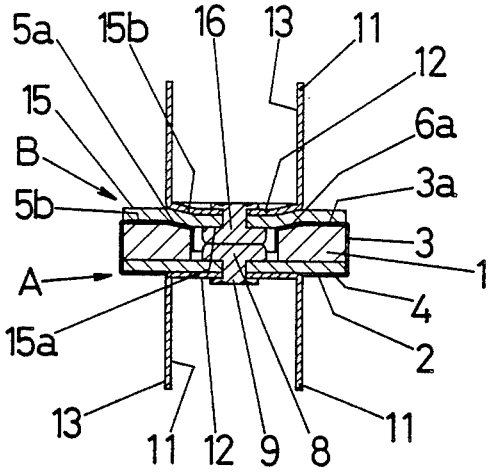
FIG. 2 is a sectional view illustrating how the first and second parts of the device in FIG. 1 are coupled together under the magnetic attraction of a permanent magnet.
Figure 3:
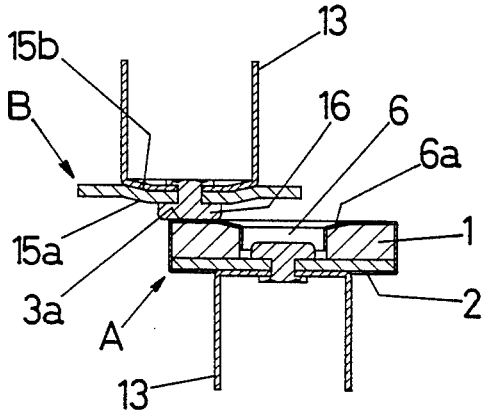
FIG. 3 is a sectional view illustrating those two parts in the process of being coupled together.

FIG. 1 is an exploded perspective view of the subassembly parts which are put together to build a magnetic lock closure device according to one preferred embodiment, and FIG. 2 illustrates in a cross-section how the first and second parts together making up the device have been coupled together under the action of the magnetism.

Referring to those figures, the device comprises a magnetically attracting part or first part A incorporating an annular permanent magnet and a magnetically attracted part or second part B. The first part A is usually attached to the body side of an article such as a woman's handbag, and the second part B is usually attached to the flap side of the article. Specifically, the first part A includes a permanent magnet 1 which usually has an annular form having a center hole 5 extending therethrough, and a first ferromagnetic member 2 which is formed like a disk plate from any suitable soft iron material and is mounted to one polarity side of the permanent magnet 1. The permanent magnet 1 and first ferromagnetic member 2 are contained within an enclosure or cover 3 which is made of any suitable nonmagnetic material. The enclosure 3 is closed at the top and has a number of projections 4, 4 extending downwardly from the peripheral bottom edge of the enclosure 3 and having the respective ends extending inwardly.

As described, the permanent magnet 1 has a center bore 5 extending through it and has a funnel-shaped portion 5*a*having an expaned opening extending outwardly from the peripheral marginal edge of the center bore 5 and having a peripheral marginal flat portion 5*b* extending radially outwardly from the funnel-shape portion 5*a*. Similarly, the enclosure 3 has center opening 6 at the top which is provided in alignment with the center bore 5 in the permanent magnet 1, and a peripheral marginal flat portion 3*a* which surrounds the center bore 6 and matches the corresponding flat portion 5*b* of the permanent magnet 1. A center bore sleeve 7 extends downwardly from the center bore 6 along the length of the center bore 5 such that it covers the inner wall of the center bore 5. At the top, the enclosure 3 has a funnel-shaped portion 6*a* having an expanded opening extending outwardly from the center opening 6 and which matches the corresponding funnel-shaped portion 5*a* of the permanent magnet 1.

The first ferromagnetic member 2 has a rod 8 at the center extending upwardly from it as viewed in FIG. 2, the rod 8 being made of any suitable ferromagnetic material and having the diameter slightly smaller than that of the center bore 5 through the permanent magnet 1 and the depth or thickness substantially equal to half the depth or thickness of the permanent magnet 1. The first ferromagnetic member 2 also has a center bore 10 extending through it, and the rod 8 has an extension 9 which extends downwardly through the center bore 10 as viewed in FIG. 2. The portion 9 of the rod 8 has its bottom end extending out of the center bore 10. A fastening member 13 which makes it possible for the first part A to be attached to the corresponding body part of the article includes a transverse base 12 and a pair of legs 11, 11 extending downwardly from each of the opposite ends of the transverse base 12 as viewed in FIG. 2. The transverse base 12 of the fastening member 13 has a center bore 14 extending through it, into which the bottom end of the rod extension 9 is inserted. The fastening member 13 and rod 8 may be combined rogether by pressing the bottom end of the rod extension 9 against the transverse base 12 of the fastening member 13 and rivetting the former to the latter.

The magnetically attracted part or second part B includes a second ferromagnetic member 15 formed like a disk plate, a second ferromagnetic rod 16 extending from the center of the second ferromagnetic member 15, and a second fastening member 13. The second ferromagnetic member 15 has the same diameter as the first ferromagnetic member 2, and is formed in a dish shape having a bore 17 at the center and a downwardly inclined portion 15*a* extending inwardly radially toward the center bore 17, such that the portion 15*a* can closely engage the flat portion 3*a* and funnel-shaped portion 6*a* of the outer enclosure 3. The second ferromagnetic rod 16 has an extension 18 which extends into the center bore 17. Like the first part A, the fastening member 13 makes it possible for the second part B to be attached to the corresponding flap part of the article and includes a transverse base 12 and a pair of legs 11, 11 extending upwardly from each of the opposite ends of the transverse base 12 as viewed in FIG. 2. The transverse base 12 of the fastening member 13 has a center bore 14 extending through it, into which the upper end of the rod extension 18 is inserted. The fastening member 13 and rod 16 may be combined together by pressing the upper end of the extension 18 of the rod 16 against the transverse base 12 of the fastening member 13 and rivetting the former to the latter.

It should be noted that for both of the first and second parts A and B, the combinations of the first ferromagnetic member 2 and and rod 8, and the second ferromagnetic member 15 and rod 16 may be provided as a single integral unit, respectively.

In the embodiment described above, when the second ferromagnetic member 15 on the second part B is placed upon the outer cover 3 on the first part A as particularly shown in FIG. 2, the lines of magnetic force from the permanent magnet 1 are centered into the first and second rods 8 and 16 which meet each other inside the bore 5 of the permanent magnet 1. Thus, those two parts A and B are coupled together under the action of the powerful magnetic attraction that is produced by the centered lines of magnetic force.

It may be noticed that when the second part B is placed upon the first part A or vice versa, the second ferromagnetic rod 16 on the second part B will more easily be attracted magnetically toward the particular area on the flat portion 3*a* of the outer cover 3 between its outer peripheral margin and center opening 6, rather than being directed toward the center opening 6, since that area provides the highest magnetic flux. In this case, it may be necessary to force the rod 16 to slide from that area toward the center opening 6 against the strong magnetic attraction of the area, but this may be accomplished simply by using the funnel-shaped portion 6*a* of the outer cover 3. As described, this portion 6*a* has the outwardly expanded opening, which allows the rod 16 to be slid directly toward the center opening 6. As a result, the distance of sliding between the initial contact point of the rod 16 on the outer cover 3 and the center opening 6 is reduced to the minimum. Thus, the rod 16 can be entered into the center opening 6 with a minimum effort and therefore with minimal scratches on the outer cover 3.

In order to develop the magnetic attraction as powerfully as possible with the two parts A and B coupled together, it is necessary to eliminate any air gaps between the first rod 8 and second rod 16 so that the two rods can closely meet each other, as well as any air gaps between the second ferromagnetic member 15 and the outer cover 3 so that they can closely contact each other. This may be achieved by designing both the permanent magnet 1 and ferromagnetic rods 8 and 16 to have their respective depths or thicknesses to meet the high dimensional precision requirements. In the presently preferred embodiment those dimensional requirements can be met by providing an annular permanent magnet formed like a flat disk plate having a center bore 5 and providing a funnel-shaped portion 5*a* having an outwardly expanded opening extending from the peripheral marginal edge of the center bore 5 and a peripheral flat portion 5*b* extending radially outwardly from the center bore 5. In the embodiment, only the peripheral flat portion 5*b* need be formed by any proper grinding or polishing means to provide a precisely flat surface. Thus, any leaks of the magnetism that may otherwise occur due to any possible air gaps can effectively be avoided, and the powerful magnetic attraction can be obtained.

As described, the second ferromagnetic member 15 has the downwardly inclined portion 15*a* which provides a depressed portion 15*b* on its upper side corresponding to the shape of the downwardly inclined portion. This has the following advantage.

Figure 4:
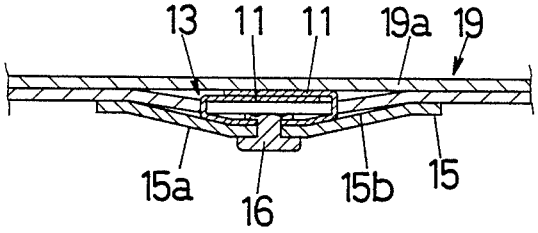
FIG. 4 is a sectional view illustrating how the second part or magnetically attracted part of the device in FIG. 1 is fastened to an article.

As for the second part B shown in FIG. 4, for example, the fastening member 13 has the legs 11, 11 which may be attached to the flap side 19 of the handbag, for example, by folding them over.

In this case, part of the fastening member 13 including the legs 11, 11 as folded over may be accommodated within the depressed portion 15*b*, and the thickness of the outer layer 19*a* of the usually double-layered handbag material (such as leather, cloth, etc.) may be reduced by the amount of that part. That is, the portion of the outer layer 19*a* that would otherwise be raised by the fastening member 13 is eliminated, keeping the handbag in good shape and appearance.

Figure 5:
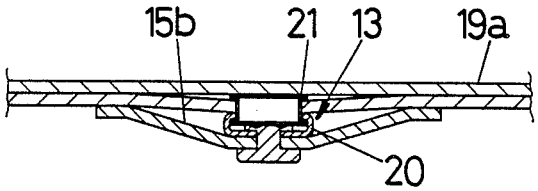
FIGS. 5 and 6 are sectional views of a variation of the fastening member, respectively, that allows the respective first or second part to be attached to the corresponding part of a particular article.
Figure 6:
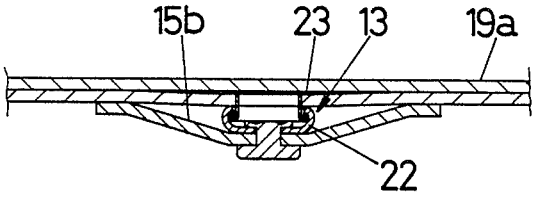

The fastening member 13 may be provided in varied forms. As shown in FIG. 5, the fastening member 13 may consist of a metal member 20 formed like a bag open at the top and a metal member 21 having its traverse base portion supported within the metal member 20 and a pair of leg portions extending upwardly from the base portion as viewed in FIG. 5. As shown in FIG.

6, the fastening member 13 may consist of a metal member 22 formed like a bag open at the top and a pair of leg portions 23 having projections which engage the metal member 22. In either case, part of the fastening member 13 may be accommodated within the depressed portion 15*b*, eliminating the portion of the outer layer 19*a* which would otherwise be raised.

Figure 7:
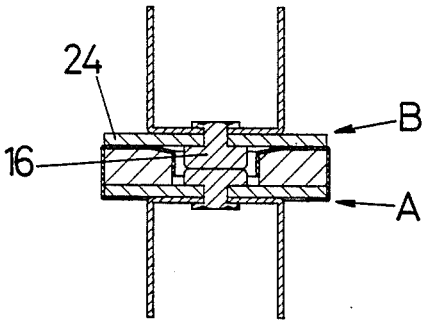
FIG. 7 is a sectional view illustrating how the first and second parts are coupled together in another preferred embodiment.

Referring next to FIG. 7, there is a device construction according to another preferred embodiment of the present invention, which is shown in cross section. In the presently described embodiment, the second ferromagnetic plate 24 on the second part B is not formed like the portion 15*a* in the preceding embodiment to accept part of the fastening member 13, but is formed flatly. The subassembly parts other than the second ferromagnentic plate 24 itself are given the same numerals as the corresponding parts in the preceding embodiment.

The presently described embodiment may not provide the equivalent effect provided by the preceding embodiment, particularly in respect of the reduced raised portion of the fastening member 13. It should be noted, however, that any possible scratches that may be produced by sliding the rod on the second ferromagnetic plate 16 can be minimized, and the subassembly parts can be fabricated with the high dimensional precision. In this respect, this present embodiment also provides the equivalent functional effect provided by the preceding embodiment, in that the powerful magnetic attraction can be provided.

The present invention has been described with particular reference to the several preferred embodiments thereof. One advantage of the present invention is obtained by providing the funnel-shaped opening extending from the center bore through the combination of the permanent magnet and outer cover and the peripheral flat portion extending radially outwardly from the funnel-shaped opening. This effectively minimizes any possible scratches on the outer cover which may occur during the sliding motion of the second ferromagnetic rod on the cover. This also eliminates the need of providing the additional sealing on the cover to protect it against such scratches. This also ensures that the two parts can be coupled together in a quick action.

Another advantage may be obtained by providing a permanent magnet that can meet the high dimensional precision requirements. This ensures that the permanent magnet provides the strong magnetic attraction when the two parts are coupled together. The fabrication yield may also be improved.

For the first embodiment in particular, an additional advantage may be obtained by providing the shape of the second ferromagnetic plate on the second part that matches the shape of the funnel portion on the first part. This allows part of the fastening member to be accommodated within the second ferromagnetic plate when the fastening member is attached to the corresponding part of an article, thus eliminating the raised portion of the fastening member.

Although the present invention has been described with particular reference to the several preferred embodiments thereof, it should be understood that various changes and modifications may be made without departing from the scope and spirit of the invention.

What is claimed is:

1. A magnetic lock closure device which comprises:

a magnetically attracting first part and a magnetically attracted second part, said first part including an annular permanent magnet having opposite poles on opposite sides thereof and a center bore therethrough between said opposite sides, a first ferromagnetic member in the shape of a disk plate attached to one side of said permanent magnet and a nonmagnetic outer cover having a center opening and enclosing said permanent magnet and said first ferromagnetic member with said center opening aligned with said center bore of said permanent magnet, said second part including a second ferromagnetic member in the shape of a disk plate and adapted to be removably engaged with said outer cover where said outer cover extends over the other side of said permanent magnet, said first and second ferromagnetic members having respective ferromagnetic rods at the center thereof and extending therefrom toward each other through the center bore and meeting each other when said first and second parts are coupled together, said permanent magnet having a funnel-shaped portion having an opening extending from said center bore and diverging outwardly to said other side of said permanent magnet, the remainder of said other side being a peripheral flat portion extending radially outwardly from the outer periphery of said outwrdly diverging opening to the peripheral edge of said magnet, said outer cover conforming to and lying immediately over said funnel-shaped portion and said peripheral flat portion, the end of said ferromagnetic rod on said second ferromagnetic member having a size and shape for, when it engages said outer cover over said peripheral flat portion when said parts are being brought into engagement, being attracted to said peripheral flat portion, and when it is moved relative to said outer cover over said peripheral flat portion, being attracted toward said center opening and downwardly along said outer cover over said funnel-shaped portion to bring said ferromagnetic rod on said second ferromagnetic member into said center bore and into contact with said ferromagnetic rod on said first ferromagnetic member and with said second ferromagnetic member against said peripheral flat portion.

* * * * *